US006074133A

United States Patent [19]

Kelsey

[11] Patent Number: 6,074,133

[45] Date of Patent: Jun. 13, 2000

[54] ADJUSTABLE FOUNDATION PIERING SYSTEM

[76] Inventor: Jim Lacey Kelsey, 863 W. 124th Dr., Westminster, Colo. 80234

[21] Appl. No.: 09/107,166

[22] Filed: Jun. 10, 1998

[51] Int. Cl.[7] ..... E02D 5/74; E02D 5/80

[52] U.S. Cl. ..... 405/244; 405/249; 405/251

[58] Field of Search ..... 405/230, 244, 405/249, 251

[56] References Cited

U.S. PATENT DOCUMENTS

| | | | |
|---|---|---|---|
| 3,902,326 | 9/1975 | Langenbach, Jr. | 61/51 |
| 4,070,867 | 1/1978 | Cassidy | 405/231 |
| 4,695,203 | 9/1987 | Gregory | 405/230 |
| 4,765,777 | 8/1988 | Gregory | 405/230 |
| 5,011,336 | 4/1991 | Hamilton et al. | 405/230 |
| 5,123,209 | 6/1992 | Nally | 52/165 |
| 5,135,335 | 8/1992 | Stephens et al. | 405/230 |
| 5,154,539 | 10/1992 | McCown, Sr. et al. | 405/230 |
| 5,176,472 | 1/1993 | Kinder | 405/230 |
| 5,205,673 | 4/1993 | Bolin et al. | 405/230 |
| 5,213,448 | 5/1993 | Seider et al. | 405/230 |
| 5,234,287 | 8/1993 | Rippe, Jr. | 405/230 |
| 5,433,556 | 7/1995 | Freeman, III | 405/229 |
| 5,492,437 | 2/1996 | Ortiz | 405/230 |
| 5,722,798 | 3/1998 | Gregory | 405/230 |
| 5,800,094 | 9/1998 | Jones | 405/230 |

*Primary Examiner*—Eileen Dunn Lillis
*Assistant Examiner*—Tara L. Mayo
*Attorney, Agent, or Firm*—H. Kenneth Johnston, II

[57] ABSTRACT

An adjustable foundation piering system in which piers are used to support a building foundation in highly expansive soil. The adjustable pier is partially incapulated in the foundation of the building when said foundation is poured. Upon settling of the foundation, the adjustable pier can be raised without an expensive piering device or substantial excavation around the foundation.

6 Claims, 4 Drawing Sheets

ADJUSTABLE FOUNDATION PIERING SYSTEM

BACKGROUND OF THE INVENTION

This invention relates to an adjustable foundation piering system and more particularly to such a system which is an improvement over the foundation supports for building and the like.

In building construction on expansive soils such as bentonite, foundations are generally built on concrete piers which according to the engineering specifications should eliminate building foundation movement over time. However this is a fallacy and the foundations are required to be re-leveled as ground movement occurs. These soils cause substantial damage to home and buildings and require expensive re-work to them. In an effort to eliminate this movement of the soil many different actions are taken. Such actions include engineered concrete piers reinforced with steel rebar which are drilled to substantial depth and in some cases to depths of up to twenty feet. Once the pier is drilled and the reinforcing rebar is added, concrete is poured into the void and must set for at least seven (7) days before additional work can be performed after the seven (7) days, the foundation can be poured with attachments to the piers. After the building is complete, non-expansive soils are placed around the foundation which has necessitated the removal of the expansive soils from the area around the foundation to reduce the amount of heaving as much as possible. When the expansive soils are encountered the entire foundation rests on the piers with void material between the ground and the base of the foundation in between each pier.

Unfortunately, all of the processes used only reduce the problem encountered with expansive soils and in time the foundation shifts as a result of the expansive soil. Where caissons with rebar have been used, the soil must be removed and the rebar must be cut that is embedded into the foundation so that the foundation can be re-leveled, and in most cases requiring a portion of the foundation to be raised. There are numerous devices utilized to re-level the foundation including piering devices. The problem is that these devices require a substantial amount of work and monies. There is a piling system of Gregory, U.S. Pat. No. 4,754,588 which attempts to eliminate the problem with soils having various compaction. This system is extremely intricate and ties the pier to the foundation with an extensive amount of steel bars extending through the sleeve. The disadvantage of this system is again obvious as when there is movement of the foundation due to expansive soils, the piling system of Gregory will require the extensive shoring of the foundation that has been a problem with the concrete piers as well.

Nally, U.S. Pat. No. 5,123,209 shows a method of re-leveling a foundation after movement has occurred.

Gregory, U.S. Pat. No. 4,695,203, shows a method of shoring building's relating to the problems set forth earlier.

In Langenbach, Jr., U.S. Pat. No. 3,902,326, it is disclosed the use of a piling member which is capable of being driven into bedrock sufficient to shore a foundation. It utilized a hydraulic pump and attachment to the foundation as a means of shoring up the foundation as shown similarly in Ortez, Freeman, III, Rippe, and McCown, U.S. Pat. Nos., 5,492,437, 5,433,556, 5,234,287, and 5,154,539, respectively. Although, there are many methods of attempting to shore up a foundation including those discussed above, none provide a stabilization system that allows for correction after the devices have been installed.

SUMMARY OF THE INVENTION

It is therefore an object of the present invention to provide an adjustable foundation piering system in which piers are used which will support a foundation system in expansive soils such as Bentonite and the like. It is a further object of the present invention to provide a system that will allow adjustments to be made after the system is installed with minimal disruption to the surrounding soils.

It is still a further object of this invention to eliminate the need for drilling a hole in the ground to receive concrete and rebar to support a foundation. It is a further object of this invention to provide a system of the above type in which the piers are formed of steel pipes. It is a further object of this invention to provide a system of the above type in which the piers are driven into bedrock for supporting the foundation.

It is still a further object of the present invention to provide a system of the above type in which a plate extends horizontally from an insert whereby the foundation rests on said plate and provides a surface in which the foundation may be risen thereby.

It is a further object of the present invention to provide a system of the above type in which a sleeve with a smaller section plug welded inside rests on the pier and having two vertical plates affixed opposed to each other for attachment of a step for providing a lower support to raise the foundation when required. Since this is a pier system from the onset, if there are movements of the earth that require adjustments to be made such as releveling the foundation, the cost of repair is substantially less than any of the other systems as a new pier is not required and only minimal excavation is required to get to the lateral supports and once the foundation is leveled, a shim cut from a pier of the same size as the initial pier is placed in the area that is raised. This results in an overall system that is far less expensive than any of the casson systems or repair pier systems. This system is equivalent to having both systems in a single system.

BRIEF DESCRIPTION OF THE DRAWINGS

The above brief description as well as further objects, features, and advantages of the present invention will be more fully appreciated by reference to the following detailed description of the presently preferred but non the less illustrative embodiments in accordance with the present invention when taken in conjunction with the accompanying drawings wherein.

DESCRIPTION OF THE PREFERRED EMBODIMENT

Figure 1:
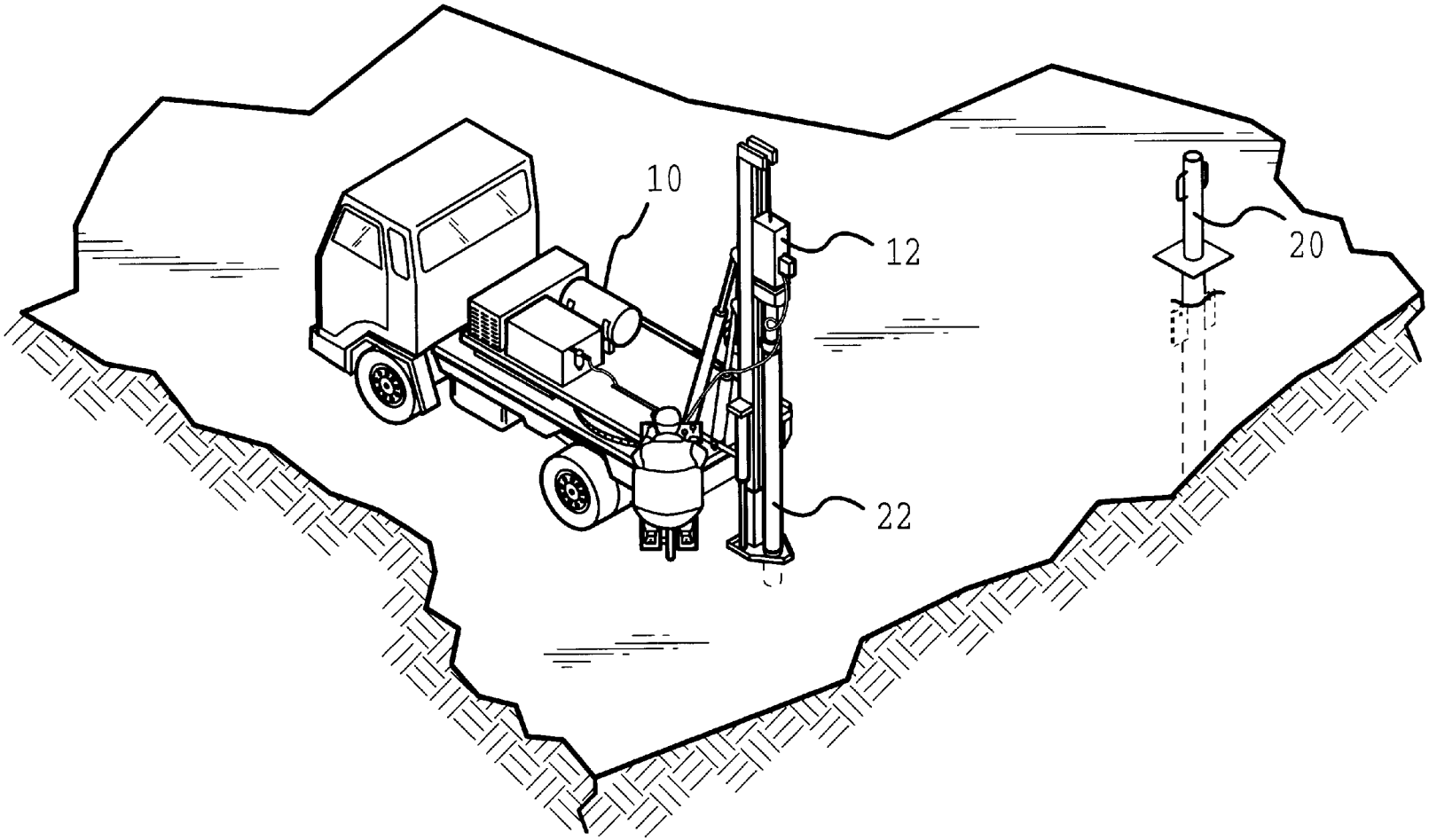
FIG. 1 is a perspective view of the adjustable pier showing its disposition in a new foundation.
Figure 2:
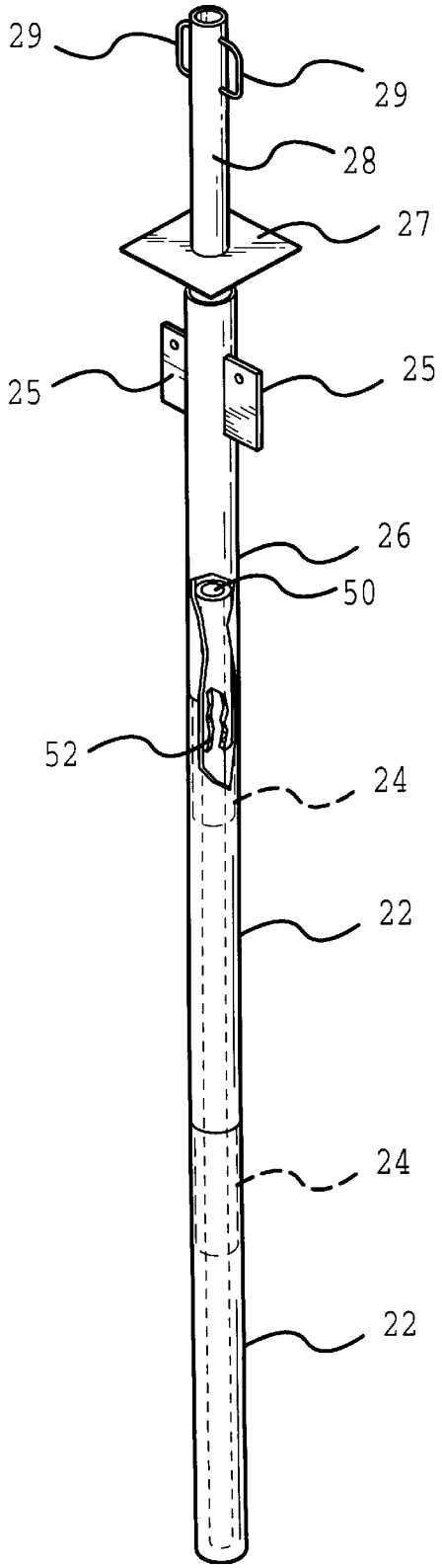
FIG. 2 is an exploded view of the adjustable pier for supporting building foundations in expandable soils showing its composite parts.

Referring to FIG. 1 of the drawings, the referenced number 20 refers in general to the adjustable pier of the present invention with pier section 22 being driven into the ground by pier driver 10. In operation pier driver 10 as shown in FIG. 1, drives pier section 22 into the ground and as shown in FIG. 2, a next pier section 22 is added having pier sleeve 24, which is essentially a length of pier having the same inside diameter as the pier section 22 outside diameter whereby said pier sleeve 24 is affixed to said pier section 22 by a normal means such as welding. Said pier sleeve 24 merely allows another pier section 22 to be added to the previously driven pier section 22 and the next pier section 22 driven into the ground. Typically, pier section 22 is 3½" O.D. schedule 40 steel pipe. This process is continued with pier driver 10 driving pier section 22 into the ground until bedrock is reached. Typically pier driver 10 is a hydraulic hammer 12 and the driving of the pier section 22 is continued until the pier section 22 is not driven any further after 20 repetitions of the hydraulic hammer 12.

Once the hydraulic hammer 12 no longer will drive pier section 22 any further into the ground with the prescribed repetitions, then pier section 2 is cut off by ordinary means level with the ground. As shown in FIG. 2, a rebar 50 and high strength grout 52 is placed in the inside of pier 22. This keeps pier sections 22 and pier sleeve 24 from separating in the event ground movement occurs and maintains the integrity of pier system 20. Upper pier portion 26 which is generally a schedule 40 pipe having an inside diameter similar to the pier sleeve 24 having a plug 30 which is a 3 to 4 inch section of the pier section 22 plug welded 31 near the upper end of upper pier portion 26 so that the upper most part of the upper pier portion 26 is level with the lower most portion of foundation 40 as shown in FIG. 3.

Pier attachment 28 which has an outside diameter slightly less than the inside diameter of the pier section 22 so that there is a snug fit between pier section 22 and pier attachment 28. Pier attachment 28 has a foundation plate 27 affixed in approximately the middle of pier attachment 28 whereby the foundation plate 27 is a ¼" flat steel plate having been cut to allow the foundation plate 27 to be slid on to the pier attachment 28 and then is affixed in a conventional means such as welding. In operation pier attachment 28 is placed into upper pier portion 26 until foundation plate 27 rests on the top of the upper pier portion 26, as shown in FIG. 3.

Figure 3:
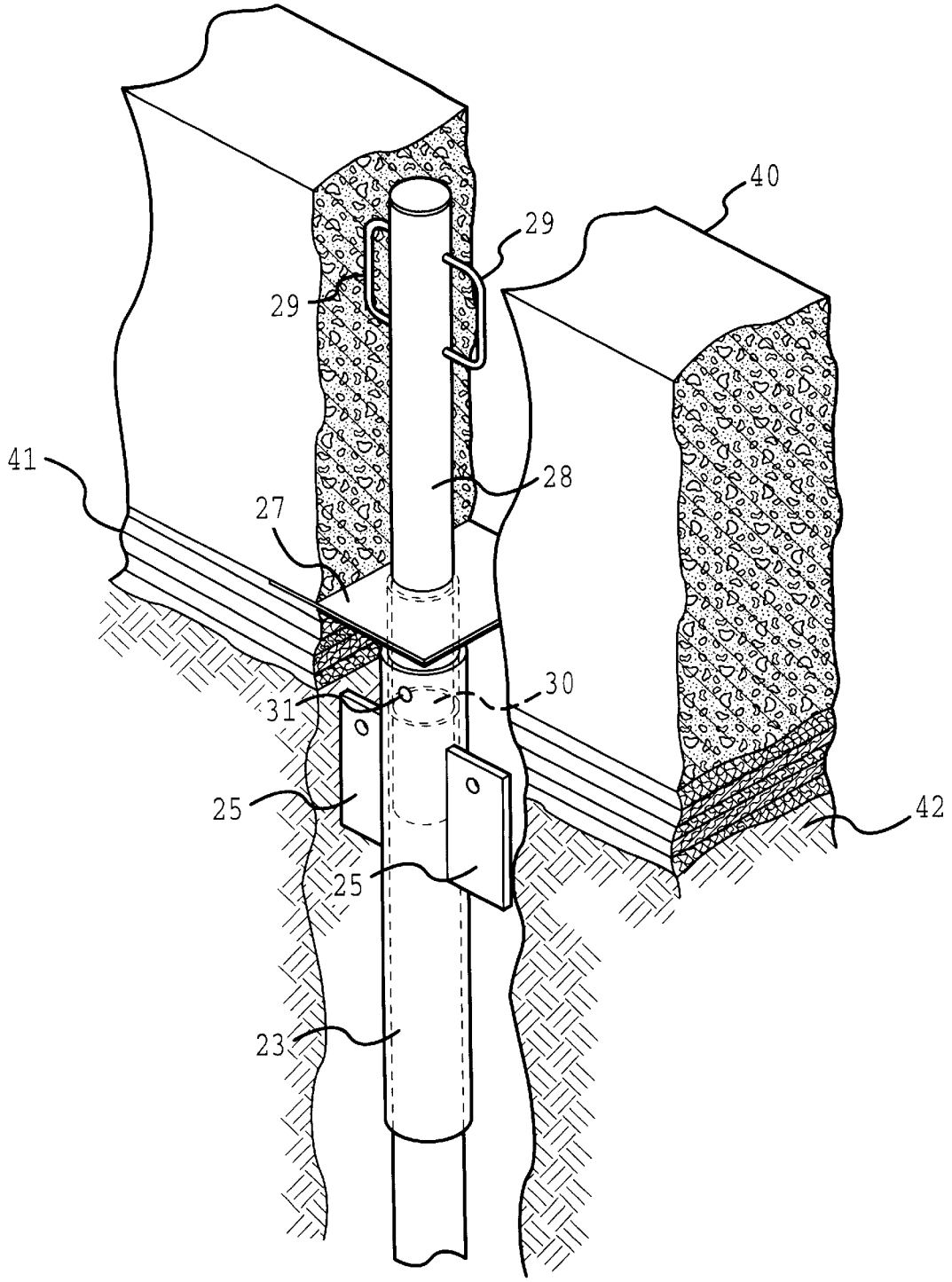
FIG. 3 is an enlarged sectional view of the adjustable pier.
Figure 4:
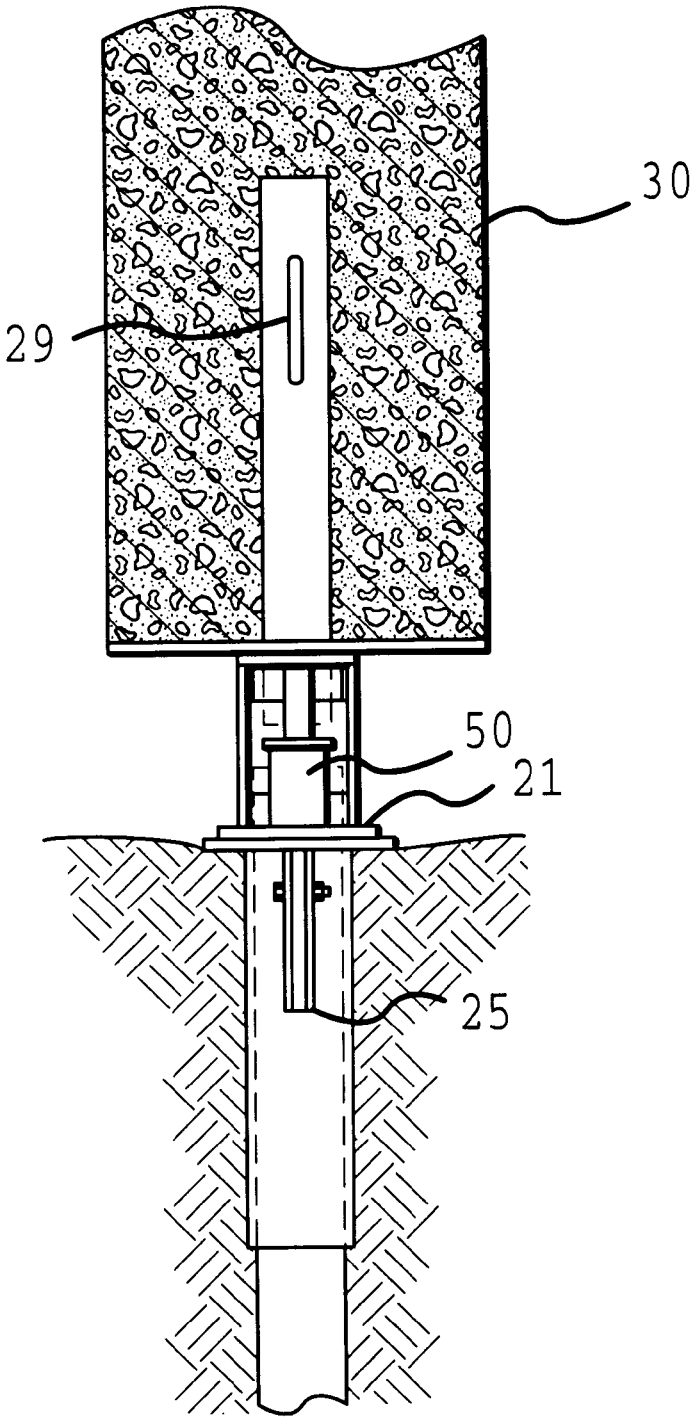
FIG. 4 is a perspective view of the adjustable pier showing it's disposition in a settled structure.

Pier attachment 28 has handle 29 welded on to its upper portion which provides assistance in carrying said pier attachment 28 and is adhered to by the concrete in the foundation 40 as shown in FIG. 3.

When foundation 40 is built on a highly expansive soil, a void material 41 is placed under the foundation 40 between the adjustable piers to prevent the heaving of the soils from damaging the foundation 40.

Additionally, the upper pier portion 26 has lateral supports 25 affixed by a standard means such as welding essentially opposing each other on said upper pier portion 26 and affixed in a manner that said lateral support 25 are in the earth 42.

Even the best pier system such as setforth hereinabove may eventually settle or heave. In the event such occurs, jack support 21 is received by lateral support 25 and held in place by bolt 33. A hydraulic jack 50 is placed between jack support 21 and foundation plate 27 and the foundation 40 is then leveled by using hydraulic jack 50. When the foundation 40 is again level, a pier section is cut to length and cut in half as a shim (not shown) and then welded together around the pier attachment and the foundation plate 28 then rests on the welded shim placing all of the weight of the lifed foundation once again on pier 22, maintaining the adjustment just made in place.

It is understood that the foregoing description and specific embodiments are merely illustrative of the best mode of the invention and the principle thereof, and various modifications and additions may be made to the apparatus and method by those skilled in the art, without departing from the spirit and scope of this invention, which is therefore understood to be limited only by the scope of the appended claims.

What is claimed:

1. An adjustable pier system for supporting a building foundation comprising:

a plurality of pier section members wherein said pier section members are connected together at the upper end of a first of said pier section members and a lower end of a second of said pier section members by a pier sleeve means having an inside diameter larger than the outside diameter of said plurality of pier section members and is permanently affixed to either said upper end of said first pier sections member or to said lower end of said second pier sections member allowing said plurality of pier section members to be driven into the ground;

an upper pier portion member having an inside diameter slightly greater than the outside diameter of said plurality of pier section members wherein said upper pier portion member has permanently affixed within its upper portion a small portion of one of said pier section members whereby said upper pier portion member rests on said one of said pier section members;

said upper pier portion member having a pair of lateral support elements permanently affixed near the middle of the upper half of said upper pier portion member wherein said lateral support elements are parallel to each other on opposite sides of said upper pier portion member; each of said lateral support elements having an opening for adhering a lifting support means;

said lifting support means having a horizontal plate means for supporting a lifting means and a vertical member means having an opening coinciding with said opening on said lateral support means for temporarily affixing said lifting support means to said lateral support means when adjustment of said foundation is required;

a pier attaching means having its outside diameter smaller than said pier section members inside diameter so that said pier attaching means slides within said upper pier portion member and said pier section members;

said pier attaching means having a gripping means permanently affixed at the upper portion of said pier attaching means for carrying said upper portion of said pier attaching means and for adherence within said building foundation;

said pier attaching means further having a foundation plate member permanently affixed horizontally to and centered within said pier attaching means whereby said foundation plate means rests on said upper pier portion member completing said adjustable pier system.

2. The adjustable pier system of claim 1 wherein said plurality of pier section members are sections of schedule 40 pipe.

3. The adjustable pier system of claim 1 wherein said pier sleeve means is a section of schedule 40 pipe having its inside diameter approximately the same size as the outside diameter of said pier section members.

4. The adjustable pier system of claim 1, wherein said upper pier portion member is a larger section of schedule 40 pipe than said pier sleeve means.

5. The adjustable pier system of claim 1 further comprising a shim affixed to said pier attaching means.

6. An adjustable pier system for supporting a building foundation comprising:

a plurality of pier sections wherein said pier sections are connected together at the upper end of a first said pier section and a lower end of a second said pier section by a pier sleeve having an inside diameter larger than the outside diameter of said pier sections and is permanently affixed to either said upper end of said first pier section or to said lower end of said second pier section allowing said plurality of pier sections to be driven into the ground;

an upper pier portion having an inside diameter slightly greater than the outside diameter of said pier sections wherein said upper pier portion has permanently affixed within its upper portion a small portion of one of said pier sections whereby said upper pier portion rests on said pier section;

said upper pier portion having a pair of lateral supports permanently affixed near the middle of the upper half of said upper pier portion wherein said lateral supports are parallel to each other on opposite sides of said upper pier portion; each of said lateral supports having an opening for adhering a jack support;

said jack support having a horizontal plate for supporting a jack and a vertical member having an opening coinciding with said opening on said lateral supports for temporarily affixing said jack support to said lateral supports when adjustment of said foundation is required;

a pier attachment having its outside diameter smaller than said pier sections inside diameter so that said pier attachment slides within said upper pier portion and said pier sections;

said pier attachment having a handle permanently affixed at the upper portion of said pier attachment for carrying said upper portion and for adherence within said building foundation;

said pier attachment further having a foundation plate permanently affixed horizontally to and centered about said pier attachment whereby said foundation plate is the base of said foundation.

* * * * *